US006142410A

United States Patent [19]

Naccache

[11] Patent Number: 6,142,410

[45] Date of Patent: Nov. 7, 2000

[54] DEVICE FOR GUIDING AN AIRCRAFT, IN PARTICULAR A MISSILE

[75] Inventor: Frédéric Naccache, Savigny-sur-Orge, France

[73] Assignee: Aerospatiale Societe Nationale Industrielle, Paris, France

[21] Appl. No.: 09/166,184

[22] Filed: Oct. 5, 1998

[30] Foreign Application Priority Data

Oct. 10, 1997 [FR] France ..... 97 12667

[51] Int. Cl.[7] ..... F41G 7/30

[52] U.S. Cl. ..... 244/3.12; 244/3.11; 244/3.14

[58] Field of Search ..... 244/3.1, 3.11, 244/3.12, 3.13, 3.14; 342/52, 58, 61, 62, 63, 64, 65, 25

[56] References Cited

U.S. PATENT DOCUMENTS

| | | | |
|---|---|---|---|
| 4,611,771 | 9/1986 | Gibbons et al. . | |
| 4,860,968 | 8/1989 | Pinson | 244/3.12 |
| 5,605,307 | 2/1997 | Batchman et al. . | |

FOREIGN PATENT DOCUMENTS

| | | |
|---|---|---|
| 0337254 | 10/1989 | European Pat. Off. . |
| 0483841 | 5/1992 | European Pat. Off. . |
| 0687626 | 12/1995 | European Pat. Off. . |
| 2433760 | 1/1976 | German Dem. Rep. . |
| 3928244 | 10/1990 | German Dem. Rep. . |

*Primary Examiner*—Bernarr E. Gregory
*Attorney, Agent, or Firm*—Stevens, Davis, Miller, Mosher, L.L.P.

[57] ABSTRACT

A device for guiding an aircraft includes an image sensor mounted on the aircraft, a data transmission unit for transmitting the images provided by the image sensor, a guide station for receiving the images which includes a touch-sensitive screen for displaying the images sensed by the image sensor. The touch-sensitive screen permits touch selection of a guide point representing a specific location displayed on the screen to which the aircraft is guided. A calculating unit calculates the instructions to guide the aircraft to the area represented by the guide point. The touch sensitive screen can include a light pen for selection of the guide point.

8 Claims, 1 Drawing Sheet

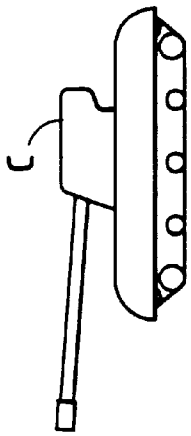
C
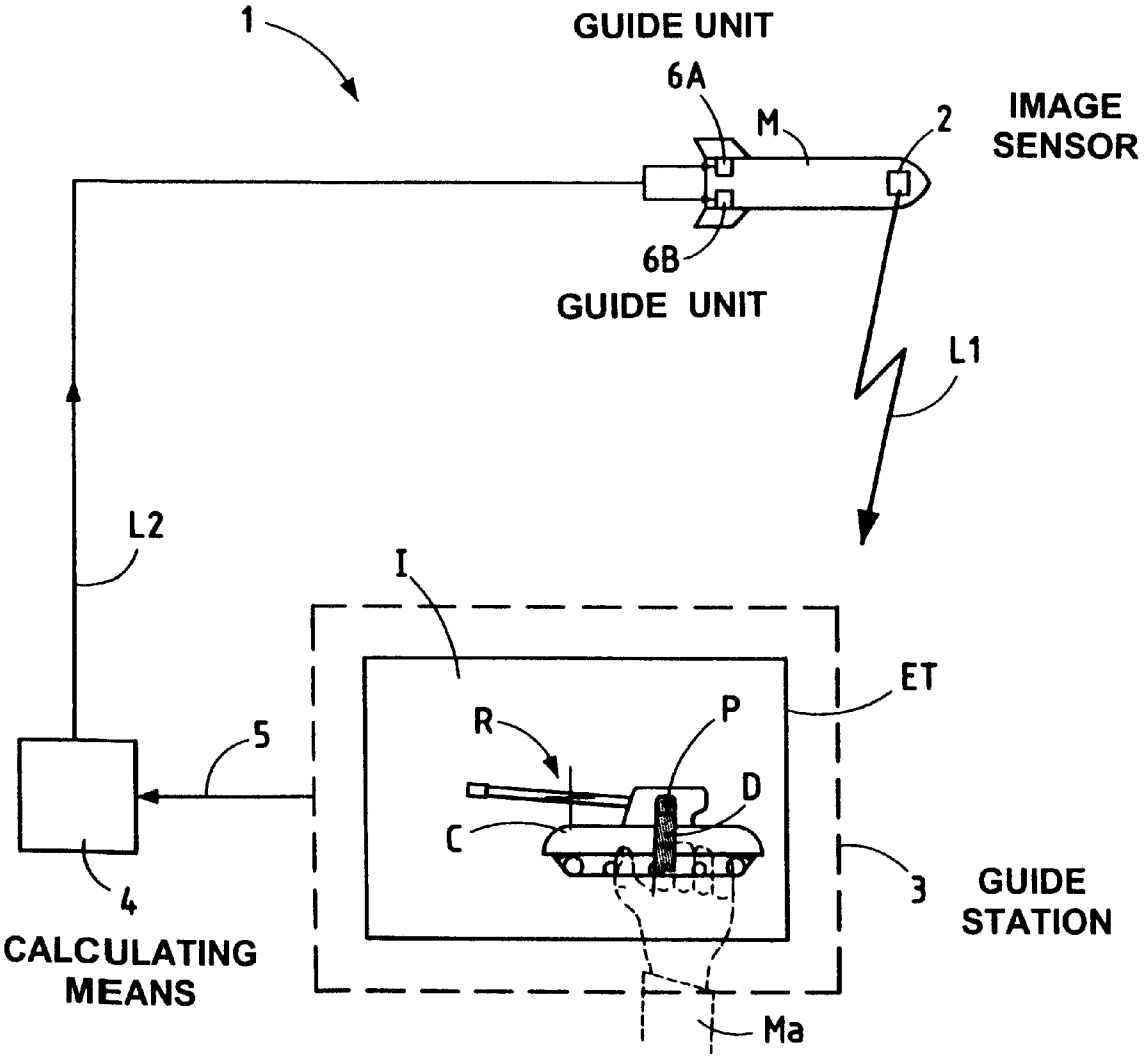
IMAGE SENSOR
2
L1
GUIDE STATION
ET
3
GUIDE UNIT
6A
M
6B
GUIDE UNIT
P
D
Ma
R
C
I
1
5
L2
4
CALCULATING MEANS

DEVICE FOR GUIDING AN AIRCRAFT, IN PARTICULAR A MISSILE

BACKGROUND OF THE INVENTION

1. Field of the Invention

The present invention concerns an aircraft, in particular a missile.

To be more precise, the present invention concerns a guidance device necessitating human intervention, namely a guidance device of the type including:

an image sensor mounted on said aircraft or on the ground and generating images of the environment ahead of said aircraft;

data transmission means;

a guidance station receiving the images generated by said image sensor through the intermediary of said data transmission means and enabling an operator to select on each image a guide point to which they wish to guide said aircraft; and calculating means which determine instructions for guiding the aircraft on the basis of the guide points thus selected, said guidance instructions being transmitted to guidance units mounted on said aircraft.

2. Description of Related Art

It is known that there is an increasing requirement for human intervention for guiding airborne weapons such as antitank missiles, for example, since only such intervention can efficiently deal with the increasingly complex situations (such as distinguishing between friends, foes and neutrals) encountered in present and/or future conflicts (political crisis, peacekeeping operation, . . . ).

Generally speaking, said guide station comprises a console provided with a screen for viewing the images generated by said image sensor and a joystick for controlling the movement of designation cross-hairs on said screen. To guide the aircraft the operator moves said designation cross-hairs to the selected point on said image, i.e. the point that the aircraft is to reach, for example the center of a target.

However, any such mode of guidance has many drawbacks and in particular delicate manipulation and difficult and slow optimization.

Because the operator often finds it difficult to master the relationship between the force they apply to the joystick and the speed and magnitude of the displacement of the designation cross-hairs on the screen, designation is generally accompanied by oscillations about the selected position that are damped to a greater or lesser degree, which obviously leads to a relatively long designation time (approximately one second in the best case) and random accuracy.

SUMMARY OF THE INVENTION

An object of the present invention is to remedy these drawbacks. It concerns a device for guiding an aircraft, in particular a missile, enabling an operator to effect the guidance in an extremely fast and accurate fashion.

To this end, in accordance with the invention, the guidance device of the aforementioned type is noteworthy in that said guide station comprises a touch-sensitive screen on which the images generated by said image sensor are displayed, the selection of said guide points being effected by point contact with the touch-sensitive screen at the points concerned, preferably either by means of a finger of the operator or by means of a light pen.

Accordingly, in accordance with the invention, the following advantages in particular are obtained:

a reduction in the designation time because the operator's finger or the light pen goes directly to the chosen point, which remedies the problems of designation oscillations in the usual solution previously mentioned; and an increase in the accuracy of designation, in particular when a light pen is used, the end of which is finer than that of a finger.

Also, it is possible to slide the finger or the light pen over the screen to track a mobile target in real time, which in particular makes it possible to dispense with automatic tracking of the target by image processing and therefore to simplify enormously the algorithms of the calculating means and thereby reduce the cost of guidance.

The transmission of data between the aircraft and the guide station on the ground is advantageously effected by means of a microwave link and/or a fiber optic link.

BRIEF DESCRIPTION OF THE DRAWINGS

The single FIGURE of the accompanying drawing explains clearly how the invention can be put into effect. It shows schematically a guidance device in accordance with the invention.

DESCRIPTION OF THE PREFERRED EMBODIMENTS

Guidance device 1 is adapted to guide an aircraft, for example a missile M, onto a target, here a tank C.

To this end, said device 1 is of the type including:

an image sensor 2 mounted on the front of the missile M and centered on its longitudinal axis generating images I of the environment which is ahead of the missile M and which includes in particular said target C;

data transmission means, not shown, which can transmit data from the missile M to the ground, as shown by a link L1, and in the opposite direction, as shown by a link L2;

a guide station 3 on the ground receiving the images I generated by said image sensor 2 and enabling an operator to select on each image I the point P to which they wish to guide said missile M, for example the center of the target C; and calculating means 4 which are connected by a link 5 to said guide station 3 and which determine instructions for guiding the missile M on the basis of the points P selected by the operator, said guidance instructions being transmitted to guidance units 6A, 6B of the usual type on the missile M through the intermediary of the link L2.

In accordance with the invention, and in particular to obtain accurate and rapid designation of the point P, said guide station 3 comprises a flat touch-sensitive screen ET on which the images I generated by the image sensor 2 are displayed and the selection of a point P is effected by means of a point contact with said touch-sensitive screen ET, either directly with a finger D of the operator, one of whose hands Ma is partly shown in chain-dotted line, or using a light pen, not shown.

The calculating means 4 then determine continuously guidance instructions which move the missile M in such a manner as to bring cross-hairs R at the center of the touch-sensitive screen ET to said selected point P and thereby to guide the missile M onto the target C.

In accordance with the invention, the transmission of data between the missile M and the ground can be effected either by means of a fiber optic link such as the link L2 or by means of a microwave link such as the link L1.

Moreover, said transmission of data can be effected either by separate means for each of the two directions of transmission or by single two-way transmission means, which simplifies said device 1.

In the embodiment described hereinabove the image sensor 2 is mounted on the missile M. However, in the context of the present invention said image sensor 2 can equally be on the ground, for example at a launch station, not shown, also comprising said guide station.

What is claimed is:

1. A device for guiding an aircraft, comprising:

an image sensor for continually generating images of an environment ahead of said aircraft;

data transmission means for transmitting the continually generated images of the environment generated by said image sensor;

guide station means including means for receiving the continually generated images of the environment transmitted by said data transmission means, said guide station means including a touch-sensitive display screen for providing a displayed image of the continually generated images of the environment and for enabling touch selection of a particular point of said displayed image as a guide point for guiding said aircraft to a specific location of the environment corresponding to the particular point of the displayed image on said display screen which has been selected by said touch selection; and calculating means which is connected to said guide station means, said calculating means for calculating guidance instructions for guiding the aircraft to the specific location of the environment corresponding to the selected guide point of said guide station means, wherein said guidance instructions are transmitted to at least one guide unit mounted on said aircraft.

2. A device according to claim 1, wherein said touch-sensitive display screen comprises a flat display surface.

3. A device according to claim 1, further comprising a pen for preforming said touch selection of the particular point of the displayed image.

4. A device according to claim 1, wherein said data transmission means includes a microwave link.

5. A device according to claim 4, wherein said guide station means is disposed at a position remote from said aircraft.

6. A device according to claim 1, wherein said data transmission means includes a fiber optic link.

7. A device according to claim 6, wherein said guide station means is disposed at a position remote from said aircraft.

8. A device according to claim 1, wherein said guide station means is disposed at a position remote from said aircraft.

* * * * *